US010517404B2

(12) United States Patent
Hopper et al.

(10) Patent No.: US 10,517,404 B2
(45) Date of Patent: Dec. 31, 2019

(54) ERGONOMIC BODY SUPPORTING CHAIR

(71) Applicants: David Hopper, Batavia, IL (US); Brian Vence, Campton Hills, IL (US); John Stanevicius, Geneva, IL (US)

(72) Inventors: David Hopper, Batavia, IL (US); Brian Vence, Campton Hills, IL (US); John Stanevicius, Geneva, IL (US)

( * ) Notice: Subject to any disclaimer, the term of this patent is extended or adjusted under 35 U.S.C. 154(b) by 135 days.

(21) Appl. No.: 15/920,417

(22) Filed: Mar. 13, 2018

(65) Prior Publication Data

US 2018/0255932 A1 Sep. 13, 2018

Related U.S. Application Data

(60) Provisional application No. 62/470,733, filed on Mar. 13, 2017.

(51) Int. Cl.

| | |
|---|---|
| ***A47C 7/50*** | (2006.01) |
| ***A47C 3/20*** | (2006.01) |
| ***A47C 7/00*** | (2006.01) |
| ***A47C 7/54*** | (2006.01) |
| ***A47C 7/68*** | (2006.01) |
| ***A61G 15/16*** | (2006.01) |
| *A47C 9/02* | (2006.01) |

(52) U.S. Cl.

CPC ..... *A47C 7/503* (2013.01); *A47C 3/20* (2013.01); *A47C 7/006* (2013.01); *A47C 7/543* (2013.01); *A47C 7/68* (2013.01); *A61G 15/16* (2013.01); *A47C 9/02* (2013.01)

(58) Field of Classification Search

None

See application file for complete search history.

(56) References Cited

U.S. PATENT DOCUMENTS

| | | | | | |
|---|---|---|---|---|---|
| 4,650,249 | A * | 3/1987 | Serber | A47C 9/005 | 248/397 |
| 4,832,407 | A * | 5/1989 | Serber | A47C 7/506 | 297/300.3 |
| 4,943,117 | A * | 7/1990 | Brown | A47C 7/503 | 297/392 |
| 5,401,078 | A * | 3/1995 | Riach | A47C 7/503 | 297/19 |
| 5,490,716 | A * | 2/1996 | Naughton | A47C 9/005 | 297/195.11 |
| 5,542,746 | A * | 8/1996 | Bujaryn | A47C 9/002 | 297/423.12 |
| 5,921,696 | A * | 7/1999 | Gillotti | A47C 9/005 | 24/270 |

(Continued)

FOREIGN PATENT DOCUMENTS

| | | | | |
|---|---|---|---|---|
| CA | 2953773 A1 * | 6/2018 | ..... | A47C 7/38 |
| KR | 101022761 B1 * | 3/2011 | ..... | A47C 9/002 |

*Primary Examiner* — David E Allred

(74) *Attorney, Agent, or Firm* — Charles Runyan

(57) ABSTRACT

A chair for supporting a body of a user in a substantially upright position relative to a vertical-axis; the chair includes a frame, a chest-support, a seat and at least one knee-support. In a preferred embodiment, the chair includes a tray configured to hold items/tools such as dentist equipment. The chair is useful for supporting the body of the user who needs to be seated for a prolonged period of time, to prevent un-comfort associated with the same.

14 Claims, 5 Drawing Sheets

(56) References Cited

U.S. PATENT DOCUMENTS

| | | | | |
|---|---|---|---|---|
| 6,543,853 | B1 * | 4/2003 | Splane, Jr. | A47C 9/005 297/195.11 |
| 6,619,747 | B2 | 9/2003 | Ko | |
| 2007/0052275 | A1 * | 3/2007 | Ghilzai | A47C 1/06 297/423.12 |
| 2007/0108805 | A1 * | 5/2007 | Manning | A47C 7/38 297/94 |
| 2010/0295357 | A1 * | 11/2010 | Koehler | A47C 1/04 297/411.2 |
| 2013/0307298 | A1 * | 11/2013 | Meiki | A61G 7/015 297/68 |
| 2015/0189992 | A1 * | 7/2015 | Richardson | A47C 15/004 297/195.11 |
| 2017/0013960 | A1 * | 1/2017 | Richardson | A61B 90/60 |
| 2017/0196371 | A1 * | 7/2017 | Liu | A47C 7/54 |
| 2018/0153638 | A1 * | 6/2018 | Paixao Correia | A61G 15/10 |

* cited by examiner

ERGONOMIC BODY SUPPORTING CHAIR

CROSS REFERENCE TO RELATED APPLICATION

The present application is related to and claims priority to U.S. Provisional Patent Application No. 62/470,733 filed Mar. 13, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of chairs and more specifically relates to an ergonomic chair for providing bodily support to a user.

2. Description of Related Art

In industrial or commercial applications, workers are often required to remain seated or standing in one position for extended periods of time. For example, during welding operations, in an assembly environment, in a food processing operation, during clerical work such as typing or mail sorting, or during surgical or dental operations, the arrangement and configuration of seating or standing positions varies considerably. Flexibility and ease of positioning equipment is highly desirable to suit the individual needs of a person, their particular preferences in a position or a variety of positions and to suit the industrial or commercial operations in which they are engaged.

Dentists, surgeons, and hygienists often experience back and neck discomfort and stress due to the awkward seated positioned maintained during surgery and dental work. Being seated places a good deal of stress on the spine and lower back. In addition, when working from a seated position, the core is not adequately supported. Reaching or leaning to perform tasks or reach instruments can put unnecessary strain on the body. It is also difficult for individuals to maintain a fast-paced work environment while getting in and out of a seated position in a chair. A suitable solution is desired.

U.S. Pat. No. 6,619,747 to Kam Ko relates to a torso and forearm supporting device for chairs and workstands. The described torso and forearm supporting device for chairs and workstands includes forearm supports for allowing the user to rest at least one forearm during forearm movement while continuously engaging the armrest. The forearm supports are individually adjustable vertically and rotatably to accommodate the dynamic and/or continuous movement of the user's arm(s). Articulated armrest brackets fold in a compact manner behind the post assembly for storage when not in use.

BRIEF SUMMARY OF THE INVENTION

In view of the foregoing disadvantages inherent in the known chair art, the present disclosure provides a novel ergonomic body supporting chair. The general purpose of the present disclosure, which will be described subsequently in greater detail, is to provide an ergonomic chair for supporting a body of a user who needs to be seated for a prolonged period of time, to prevent un-comfort associated with the same, yet the individual is able to perform the desired task(s).

A chair is disclosed herein. The chair includes a frame which may include a vertical-length relative to a vertical-axis. The vertical-length may be defined by a top-end and a bottom-end, and the bottom-end may include a base configured to support the chair on a ground-surface.

A chest-support may be fixedly attached to the frame about the top-end and configured to support a chest of the user. Further, a seat may be fixedly attached to the frame about a mid-point between the top-end and the bottom-end and configured to support a buttocks of the user. In addition to this, at least one knee-support may be attached to the frame about the bottom-end and may be configured to support a first knee and a second knee of the user.

A method of using this chair is also disclosed herein. The method of using the chair may comprise the steps of: a providing the chair as above; sitting on the seat; resting the chest of the user against the chest-support; and resting the first knee and the second knee of the user against the at least one knee-support.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an ergonomic body supporting chair, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to chairs and more particularly to an ergonomic body supporting chair as used to improve bodily support to a user.

Generally disclosed is an ergonomically designed chair that may enable the user to perform tasks while in a quarter-squat position. The chair may alleviate spinal compression and stress from the lower back of the user by distributing the force to the knees, lower legs, and feet. Further, the chair may offer additional stability to the user's core, allowing for extended use of the arms without additional strain or discomfort. A moveable tray may be provided on the front of the chair to allow for quick and easy access to tools or supplies. The chair may enable dentists, surgeons, hygienists, and other professionals to work on patients or projects with minimal strain on the body.

The chair may comprise a V-shaped base (or other shape), a seat, a moveable tray, and a chest rest. The base may comprise wheels and knee rests. The wheels may be structured and arranged to brake and lock when a person sits on the chair. The knee rests may comprise a support to bear the weight of the user's legs when seated on the chair and balance the user. Further, the seat may comprise buttocks support at a height that may be between a standard chair seat position and a squatting position. The seat may include an angled seat pad.

The moveable tray may comprise an area to place tools and attachment points to attach common tools used by a professional. The tray may be half-moon shaped and include an elbow rest pad. The chest rest may comprise a moveable support to rest and support the weight of the chest of a user. A shoulder rest may also be included; however, the shoulder pad may be adjustable and may be pulled back. The chair may further be adjustable in various locations to accommodate users of various sizes. The exact specifications may vary upon manufacturing.

Referring now more specifically to the drawings by numerals of reference, there is shown in FIGS. 1-4, various views of a chair 100.

Figure 1:
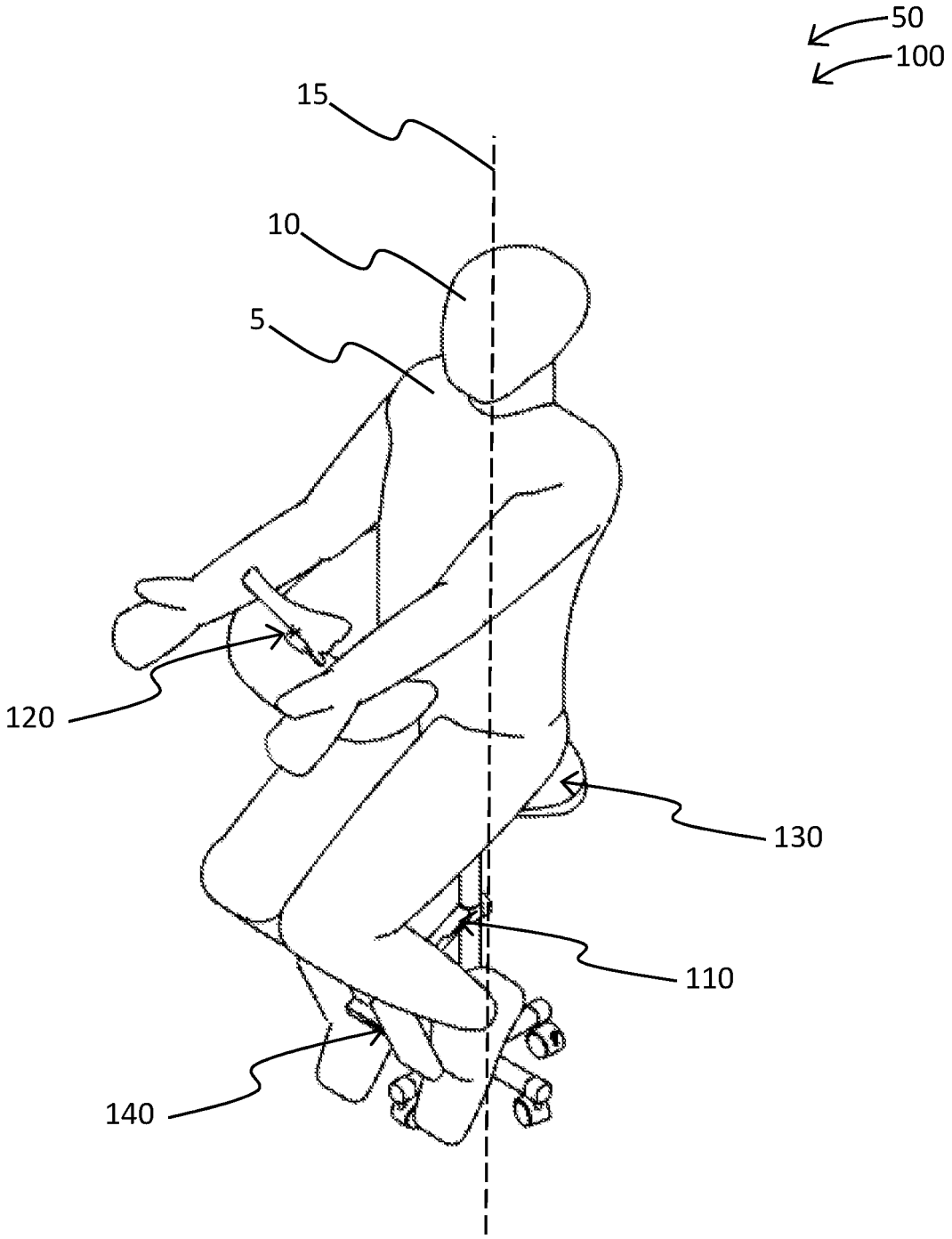
FIG. 1 is a side-front perspective view of the chair during an 'in-use' condition, according to an embodiment of the disclosure.

FIG. 1 shows a chair 100 during an 'in-use' condition 150, according to an embodiment of the present disclosure. As illustrated, the chair 100 may include a frame 110, a chest-support 120, a seat 130 and at least one knee-support 140. As shown, the chair 100 may be used for supporting a body 5 of a user 10 in a substantially upright position relative to a vertical-axis 15. The chair 100 may be useful in a wide range of applications. For example, the chair 100 may have uses in commercial, industrial, medical, office and art settings. An example of an art setting may be tattoo art, and the chair 100 may be used by a tattoo artist when tattooing a client. It should however be appreciated that this list is not exhaustive, and the chair 100 is not limited in its use.

Figure 2:
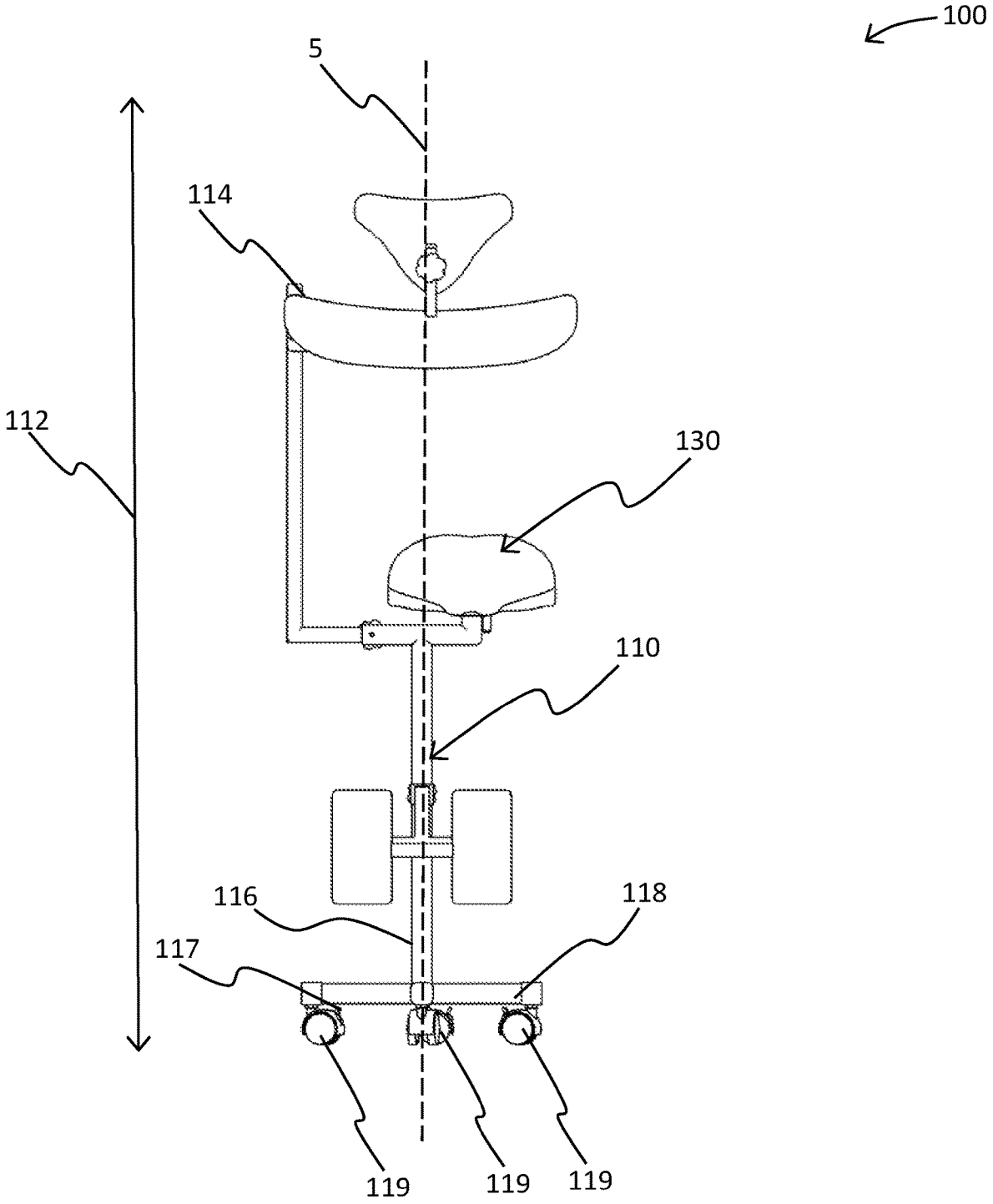
FIG. 2 is a front perspective view of the chair of FIG. 1, according to an embodiment of the present disclosure.

Referring now to FIG. 2 showing a front perspective view of the chair 100 of FIG. 1, according to an embodiment of the present disclosure. As shown, the frame 110 may include a vertical-length 112 relative to the vertical-axis 15. The vertical-length 112 may be defined by a top-end 114 and a bottom-end 116. In a preferred embodiment, the vertical-length 112 may be adjustable to accommodate a variety of users 10. Further, as shown, the bottom-end 116 may include a base 118 configured to support the chair 100 on a ground-surface (floor or the like). The base 118 may include at least four wheels 119 configured to provide portability to the chair 100 and each of the at least four wheels 119 may include a brake 117 configured to lock the at least four wheels 119 in place. The brake 117 may be manually actuated by the user 10 (FIG. 1) when they do not want the chair 100 to move. In other embodiments, the brake 117 may be automatically actuated when the user 10 sits on the seat of the chair 100.

Figure 3:
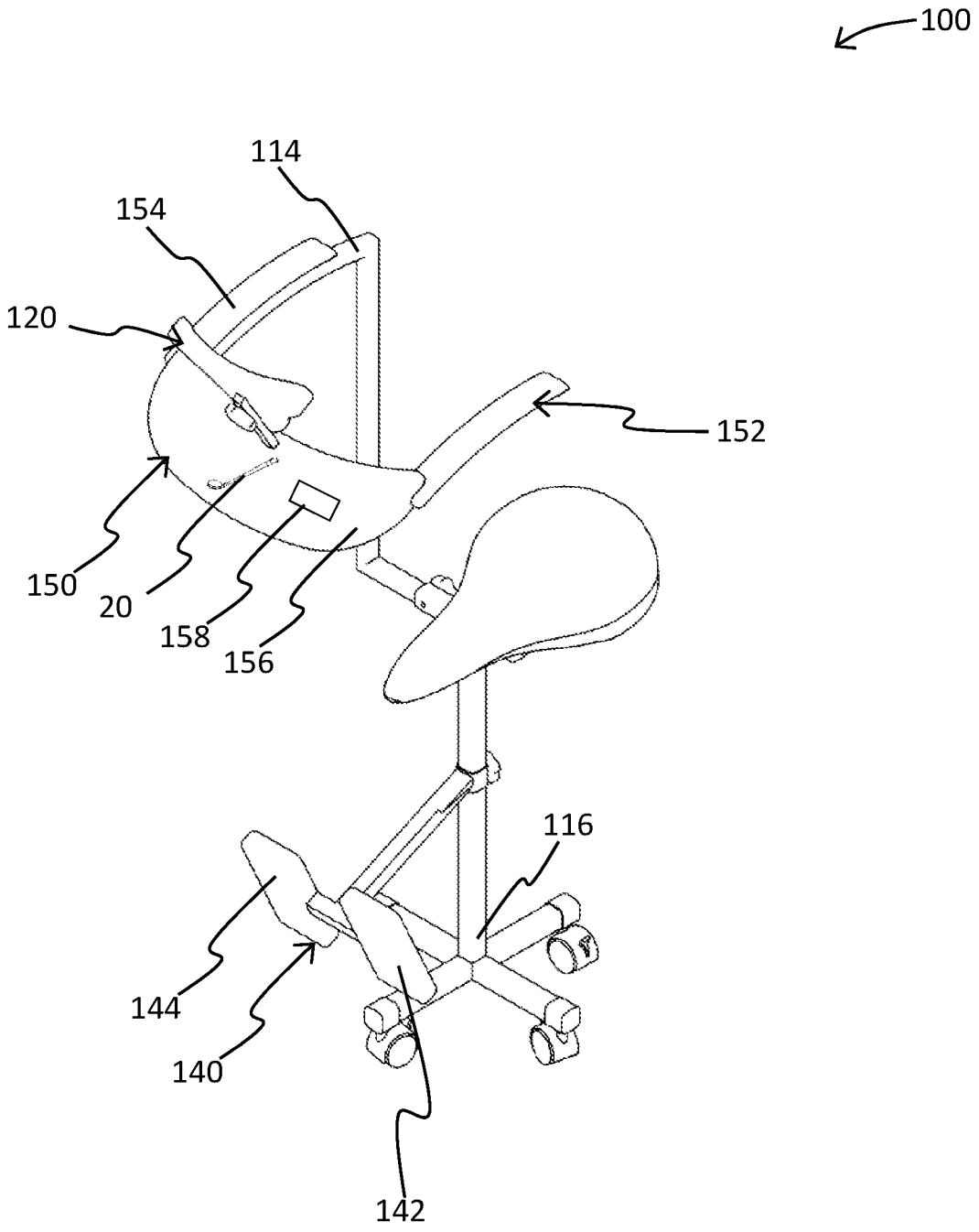
FIG. 3 is a side-front perspective view of the chair of FIG. 1, according to an embodiment of the present disclosure.

FIG. 3 shows a side-front perspective view of the chair 100 of FIG. 1, according to an embodiment of the present disclosure. As shown in this figure, the chair 100 may further comprise a tray 150 attached to the frame 110 about the top-end 114 and adjacent to the chest-support 120. The tray 150 may be movable such that the user 10 may move the tray 150 into different positions about the chair 100. The tray 150 may further include a brake to lock the tray 150 into place once it has been placed in a desired position.

In the preferred embodiment, the tray-surface 156 may be configured to hold at least one item 20. Further to this, at least one attachment-means 158 may be provided and configured to secure the at least one item 20 to the tray 150. Examples of attachment-means 158 may include hook and loop fastener, elastic-straps, a recess with the tray 150, etc. In this embodiment, the at least one item 20 may be particular to the users' 10 use of the chair 100. For example, if the user 10 is a dentist using the chair 100 for performing dental work on a patient, the at least one item 20 may be a plurality of tools relating to the dental work. The tray-surface 156 may be provided to allow easy access to the plurality of tools. As shown, the tray 150 may comprise a half-circle shape. In addition, the tray-surface 156 may be made from a plastic-material to provide a sturdy support base 118 for the at least one item 20.

In one embodiment, the tray 150 may include a first elbow-rest 152 and a second elbow-rest 154 configured to support a first elbow and a second elbow of the user 10, respectively. The first elbow-rest 152 and the second elbow-rest 154 may be particularly useful for the user 10 when the tray 150 is in use as the user 10 may rest the first elbow and the second elbow on the first elbow-rest 152 and the second elbow-rest and have easy access to the tray 150 whilst the first elbow-rest 152 and the second elbow-rest 154 provide comfort to the user 10.

As illustrated here, the at least one knee-support 140 may be attached to the frame 110 about the bottom-end 116, and as shown in FIG. 1, the at least one knee-support 140 may be configured to support a first knee and a second knee of the user 10. The at least one knee-support 140 may include a first knee-support 142 and a second knee-support 144, the first knee-support 142 being configured to support the first-knee of the user 10, and the second knee-support 144 being configured to support the second-knee of the user 10. The first knee-support 142 and the second knee-support 144 may be parallel and opposite to each other.

Further, the first knee-support 142 and the second knee-support 144 may comprise a cushion-material to provide comfort to the chest of the user 10. The cushion-material may include an outer-shell made from a material such as leather, plastic, fabric, etc. The outer-shell may be stuffed with a material configured to provide the comfort such as foam, polyester, etc. The cushion-material may include a rigidity to allow for the support of the body 5 of the user 10.

Figure 4:
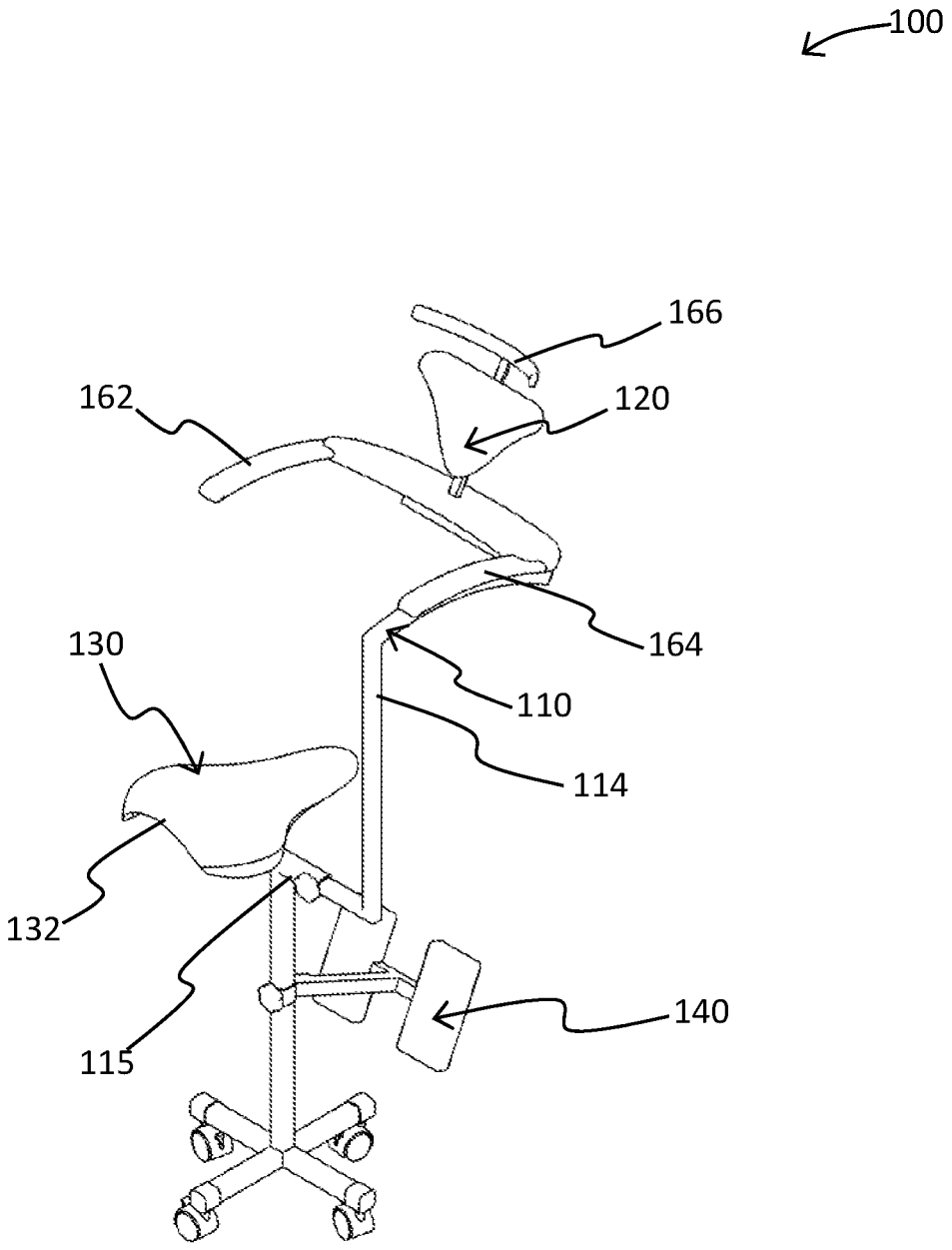
FIG. 4 is a side-rear perspective view of the chair of FIG. 1, according to an embodiment of the present disclosure.

Referring now to FIG. 4 showing a front-rear perspective view of the chair 100 of FIG. 1, according to an embodiment of the present disclosure. The chest-support 120 may be fixedly attached to the frame 110 about the top-end 114 and as shown in FIG. 1, the chest-support 120 may be configured to support a chest of the user 10. The chest-support 120 may be substantially triangular in shape and may include the cushion-material to provide comfort to the chest of the user 10. Further, the chest-support 120 may be adjustable. In the preferred embodiment, a height of the chest-support 120 may be adjustable to accommodate a variety of users 10 of different sizes, and also to accommodate a plurality of uses for the chair 100. For example, the height of the chest-support 120 may need to be higher when performing a certain task such as dental work, as compared with other tasks.

Further, a first arm-rest 162 and a second arm-rest 164 may located about the top-side of the frame 110, the first-arm rest and the second arm-rest 164 configured to support a first-arm and a second-arm of the user 10, respectively. As shown, the first arm-rest 162 and the second arm-rest 164 may be located either side of the chest-support 120. In the preferred embodiment, the first arm-rest 162 and the second arm-rest 164 may include the cushion-material to provide the comfort to the user 10. Similarly, the chair 100 may include a shoulder-support 166 located about the top-side of the frame 110 and configured to support a first shoulder and a second shoulder of the user 10. In the preferred embodiment, the shoulder-support 166 may be adjustable and moveable such that the user 10 may move the shoulder-support 166 when not needed.

As shown, the seat 130 may be fixedly attached to the frame 110 about a mid-point 115 between the top-end 114 and the bottom-end 116. The seat 130 may be configured to support a buttocks of the user 10. Further, the seat 130 may include a seat-pad 132 made from the cushion-material as above. In addition to this, the seat-pad 132 may be angled. In this embodiment, the seat may be angled towards the chest-support 120 of the chair 100 and configured to lean the user 10 into the chest-support 120 and the at least one knee-support 140 further in order to distribute a weight of the user 10 into the same.

Figure 5:
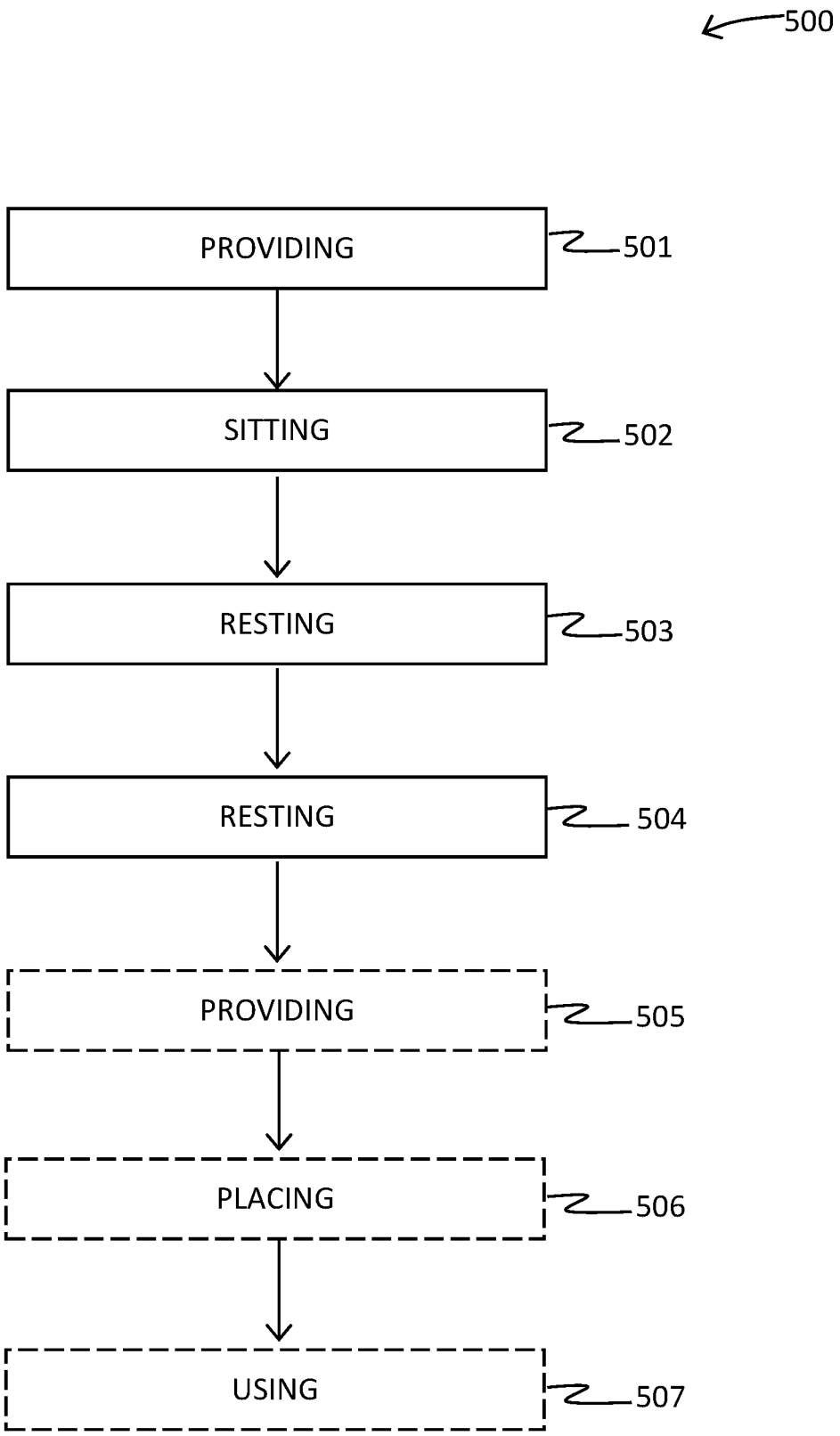
FIG. 5 is a flow diagram illustrating a method of use for the chair, according to an embodiment of the present disclosure.

FIG. 5 is a flow diagram illustrating a method of using a chair for supporting a body of a user 500, according to an embodiment of the present disclosure. As illustrated, the method of using a chair for supporting a body of a user 500 may include the steps of: step one 501, providing the chair 100 as above; step two 502, sitting on the seat 130; step three 503, resting the chest of the user 10 against the chest-support 120; and step four 504, resting the first knee and the second knee of the user 10 against the at least one knee-support 140. Further steps may include step five 505, providing the chair 100 for supporting the body 5 of the user 10 further including a tray 150 attached to the frame 110 about the top-end 114 and adjacent to the chest-support 120; step six 506, placing at least one item 20 in the tray 150; and step seven 507, using the at least one item 20 whilst sitting in the seat 130.

It should be noted that step six 506 and step seven 507 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for chair 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A chair for supporting a body of a user in a substantially upright position relative to a vertical-axis, the chair comprising:

a frame including a vertical-length relative to the vertical-axis, the vertical-length being defined by a top-end and a bottom-end, wherein the frame comprises an upper body supporting portion including an upper L-shaped member at the top-end with a first leg extending lengthwise laterally outward from a distal end of the upper body supporting portion and connected to a second leg of the upper L-shaped member, the second leg extending lengthwise rearwardly to a connection with a first leg of a lower L-shaped member, the first leg of the lower L-shaped member extending longitudinally downward and connected to a second leg of the lower L-shaped member that extends lengthwise laterally inward, and wherein the bottom-end includes a base configured to support the chair on a ground-surface, wherein the frame includes a seat post extending lengthwise upwardly from the bottom-end towards a mid-point between the top-end and the bottom-end of the frame, and wherein the upper body supporting portion is connected to the seat post by the second leg of the lower L-shaped member generally at the mid-point;

first and second armrests fixedly attached at the top-end to the upper body supporting portion at the upper L-shaped member;

a tray fixedly attached at the top-end to the upper body supporting portion at the upper L-shaped member, wherein the first and second armrests and the tray form a rearwardly opening U-shape;

a chest-support fixedly attached to the upper L-shaped member in the upper body supporting portion of the frame at the top-end, the chest-support being adapted to support a chest of the user;

a seat fixedly attached to the frame proximate the mid-point, the seat adapted to support a buttocks of the user; and at least one knee-support attached to the seat post of the frame, the at least one knee-support being adapted to support a first knee and a second knee of the user.

2. The chair of claim 1, wherein the vertical-length is adjustable to accommodate a variety of users.

3. The chair of claim 1, wherein the base includes at least four wheels configured to provide portability to the chair.

4. The chair of claim 3, wherein the at least four wheels each include a brake configured to lock the at least four wheels in place.

5. The chair of claim 1, further comprising the tray attached to the frame adjacent to the chest-support.

6. The chair of claim 5, wherein the tray comprises a half-circle shape.

7. The chair of claim 6, wherein the tray further includes a first elbow-rest and a second elbow-rest adapted to support a first elbow and a second elbow of the user, respectively.

8. The chair of claim 7, wherein the tray includes a tray-surface configured to hold at least one item.

9. The chair of claim 8, wherein the tray-surface includes at least one attachment-means configured to secure the at least one item to the tray.

10. The chair of claim 1, further comprising a shoulder-support supported on the chest-support, the shoulder-support being adapted to support a first shoulder and a second shoulder of the user.

11. The chair of claim 10, wherein the shoulder-support is moveable.

12. The chair of claim 1, wherein the seat includes a seat-pad.

13. The chair of claim 12, wherein the chest-support is adjustable.

14. The chair of claim 1, wherein the at least one knee-support includes a first knee-support and a second knee-support, the first knee-support being adapted to support the first-knee of the user, and the second knee-support being adapted to support the second-knee of the user.

* * * * *